United States Patent [19]

Price

[11] Patent Number: 4,757,853

[45] Date of Patent: Jul. 19, 1988

[54] SAFETY DEVICE FOR GARAGE DOOR SPRINGS

[75] Inventor: Frank S. Price, 21 Winding Way, Berlin, N.J. 08009

[73] Assignees: Frank S. Price; Elizabeth Price, both of Berlin, N.J.

[21] Appl. No.: 931,518

[22] Filed: Nov. 14, 1986

[51] Int. Cl.[4] ..... E05F 11/00

[52] U.S. Cl. ..... 160/191; 49/197; 267/74; 267/179

[58] Field of Search ..... 160/191, 192, 193, 201, 160/189; 49/200, 197; 267/69, 73, 74, 179

[56] References Cited

U.S. PATENT DOCUMENTS

| | | | |
|---|---|---|---|
| 1,598,480 | 8/1926 | Deal | 267/74 |
| 1,616,133 | 2/1927 | Lowy | 267/74 |
| 1,690,957 | 11/1928 | Tommins | 267/74 |
| 1,983,856 | 12/1934 | Johnson | 160/191 |
| 2,129,338 | 9/1938 | Timmons | 267/74 X |
| 2,271,309 | 1/1942 | Rowe | 160/191 |
| 2,323,807 | 7/1943 | Ferris et al. | 160/191 |
| 2,953,928 | 9/1960 | Anderson et al. | 49/200 X |
| 3,041,060 | 6/1962 | Jacobsen | 267/73 X |
| 3,429,072 | 2/1969 | Sammons | 267/74 X |
| 3,860,226 | 1/1975 | Hensiek | 267/69 |
| 3,958,367 | 5/1976 | Fairman | 49/197 |
| 4,082,133 | 4/1978 | Halopoff | 49/197 X |
| 4,640,049 | 2/1987 | Duncan | 49/197 |

*Primary Examiner*—Ramon S. Britts
*Assistant Examiner*—David M. Purol
*Attorney, Agent, or Firm*—Norman E. Lehrer

[57] ABSTRACT

A safety device for use with an overhead garage door assembly which includes elongated coil springs on either side of the door counterbalancing the door weight for assisting in the opening and closing of the door. The safety device includes an elongated flexible member extending longitudinally through each of the coil springs and being secured at its ends to fixed supports. Each end of each spring is substantially surrounded by a substantially tubularly shaped member which includes an end cap. The ends of each spring are secured to their respective supports through holes in the end caps and additional holes allow the elongated flexible members to pass therethrough. Whereby broken portions of a spring will be retained either on the elongated flexible member or within the tubular members in the event of breakage of the coil spring.

3 Claims, 2 Drawing Sheets

SAFETY DEVICE FOR GARAGE DOOR SPRINGS

BACKGROUND OF THE INVENTION

The present invention is directed toward an overhead garage door assembly and more particularly to an improved safety device therefor which is adapted to retain broken portions of a counterbalance coil spring in the event of breakage of the spring.

Counterbalance coil springs have been used for many years in most overhead garage door structures for assisting the operator in the opening and closing of the door. Such springs are utilized even when motorized automatic garage door openers are utilized since the garage doors are relatively heavy and the springs provide the needed assistance to raise the doors and to prevent the doors from closing too quickly and out of control.

The counterbalance springs which are normally used are tension springs which, when stretched the required amount, are placed under very considerable tension. It is known that after a period of time and use, the spring metal may rupture due to wear. Such rupture inevitably occurs when the spring is at virtually full tension. As a result, upon breakage, the tension is released and broken pieces of spring may be flung about with considerable force which may cause injury to property or people in the vicinity.

Proposals have been made in the past to reduce the likelihood of any such injury by providing a flexible cable or the like which passes entirely through each coil spring and is secured to a structural member at each end and preferably beyond the end of each spring. Examples of such devices are shown in U.S. Pat. Nos. 3,958,367 to Fairman and 4,082,133 to Halopoff. In theory, if there is a breakage of the spring when utilizing either the Fairman or Halopoff devices, the elongated member passing through the spring will retain the broken pieces of the spring. It has been found, however, that breakage most frequently occurs at the very end of the spring where it is normally bent into a hook so that it can be secured to a support. Since the elongated member of the prior art devices does not pass through this portion of the spring, it will not retain the same in the event of a breakage and damage or injury can still occur.

SUMMARY OF THE INVENTION

The present invention is designed to overcome the shortcomings of the prior art devices described above. The safety device of the present invention is specifically designed for use with an overhead garage door assembly which includes elongated coil springs on either side of the door counterbalancing the door weight for assisting in the opening and closing of the door. The safety device includes an elongated flexible member extending longitudinally through each of the coil springs and being secured at its ends to fixed supports. Each end of each spring is substantially surrounded by a substantially tubularly shaped member which includes an end cap. The ends of each spring are secured to their respective supports through holes in the end caps and additional holes allow the elongated flexible members to pass therethrough. Whereby broken portions of a spring will be retained either on the elongated flexible member or within the tubular members in the event of breakage of the coil spring.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
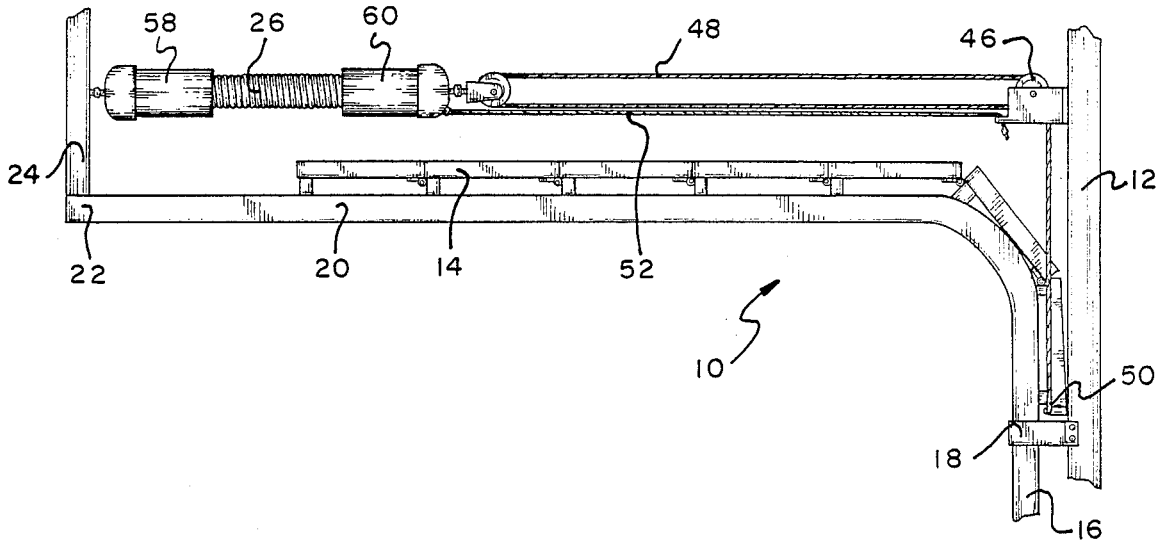
FIG. 1 is a side elevational view of an overhead garage door assembly with the door in an open position and showing a safety device constructed in accordance with the principles of the present invention.

Referring now to the drawings in detail wherein like reference numerals are used throughout the various figures to designate like elements, there is shown in FIG. 1 a side elevational view of a portion of an overhead garage door assembly which includes the safety device of the present invention and which assembly is generally designated as 10. The garage door assembly 10 is shown carried by a building structure such as a garage, a portion of which is shown at 12 and which has an opening therein which is adapted to be closed by a garage door. The actual garage door and associated track and moving system for which the safety device of the present invention is intended is generally known and does not, per se, form a part of the improvement of the present invention. The following description of those aspects of the garage door assembly will, therefore, be relatively brief as they are well known to those skilled in the art. Reference may be had to the above-mentioned patent to Fairman for a more detailed showing of one example of a conventional garage door assembly with which the present invention may be used.

Figure 2:
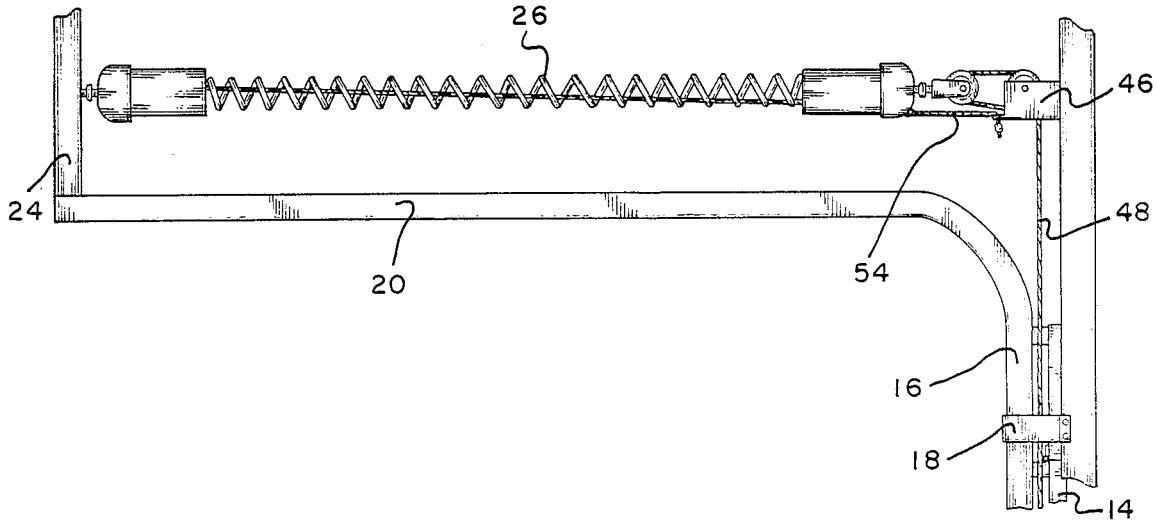
FIG. 2 is a side elevational view similar to FIG. 1 but showing the garage door in a closed position.

The garage door 14 shown in an open position in FIG. 1 and in a closed position in FIG. 2 is comprised of a plurality of horizontally arranged panels which are hinged together at their tops and bottoms. However, this is by way of example only since the present invntion may also be used with overhead garage doors which are comprised of a single door panel which is pivoted between a vertical closed position and a horizontal open position.

A vertical track section 16 is secured to either side of the door opening through a plurality of support brackets 18. Only one of the track sections 16 is shown in FIGS. 1 and 2. It will be understood, however, that a mirror image of this track section appears on the other side of the door opening. A horizontal overhead section of track 20 extends from its front end (at the right in FIGS. 1 and 2) where it connects to the vertical track section 16 to a free rear end 22 where it is supported to a structural support member 24. As is well known in the art, the door 14 has opposite side edges which carry rollers thereon slideably mounted in the respective track sections 16 and 20 so that the door 14 may be moved between its vertical closed position as shown in FIG. 2 and its horizontal open position as shown in FIG. 1.

A counterbalance spring assembly is located on either side of the door 14 with a different spring assembly associated with each horizontal track section. Each spring assembly includes a coil spring 26 which lies substantially parallel to its respective track section. The rear end 28 of spring 26 is secured to the rear support 24 through a bolt hook 30. Hook 30 has its end threaded as shown at 32 and passes through an opening in the support 24, thus allowing for limited movement to the left as viewed in FIG. 4. Movement to the right, however, is stopped by nut 34 secured to the end of the bolt.

The forward end 36 of spring 26 (see FIG. 6) is supported by a similar bolt hook 38 which has its threaded end 40 passing through bracket 41 supporting to a movable pulley 42 thus allowing for limited movement of the bolt 38 to the right. Movement of the bolt to the left, however, is stopped by nut 43 secured to the end of the bolt engaging the bracket 41. A forward fixed support 44 carries a fixed pulley 46. An elongated flexible rope or cable 48 has one end 50 secured to the bottom of the door 14. The cable passes around the fixed pulley 46 and then around the movable pulley 42 and has its other end secured to the forward fixed support 44. As is well known in the art, when the door 14 is in its vertical or closed position as shown in FIG. 2, the cable 48 through the pulleys 42 and 46 tension the spring 26 into its full extended or tensioned state as shown in FIG. 2. In this condition, the tension force of the spring 26 can be used to aid the operator in lifting the door 14. As the door is lifted into its substantially horizontal and open position as shown in FIG. 1, the spring 26 moves into its relaxed or untensioned state as shown in FIG. 1.

In order to help prevent broken portions of the spring 26 from being flung about and causing injury or damage in the event that the spring 26 breaks, an elongated flexible rope member 52 passes axially through the center of each coil spring 26. The forward end 54 of each flexible rope member 52 is secured to the front support member 46. The rear end 56 of each rope member 52 (see FIG. 4) is secured to the rear structural support 24. The end 56 may be either directly connected to the rear support 24 or it may be connected to the hook 30 which, in turn, is connected to the support as described above. Preferably, the flexible rope member 52 is under slight tension so that it will be capable of supporting the spring 26 in the event that it breaks.

Figure 4:
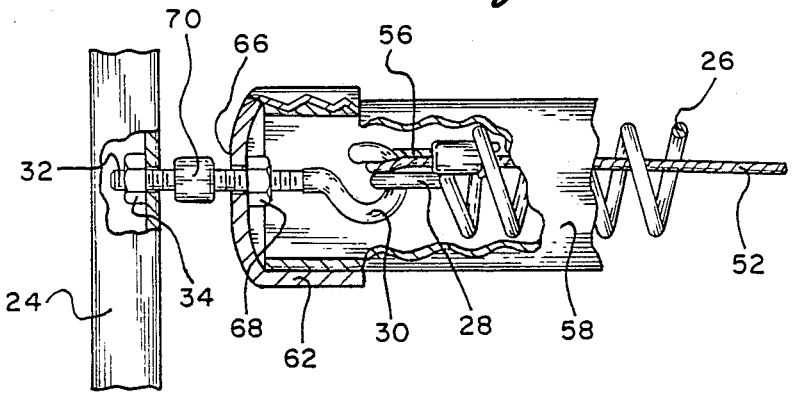
FIG. 4 is a view similar to FIG. 3 but with a portion broken away so as to show the details of the interior thereof.
Figure 5:
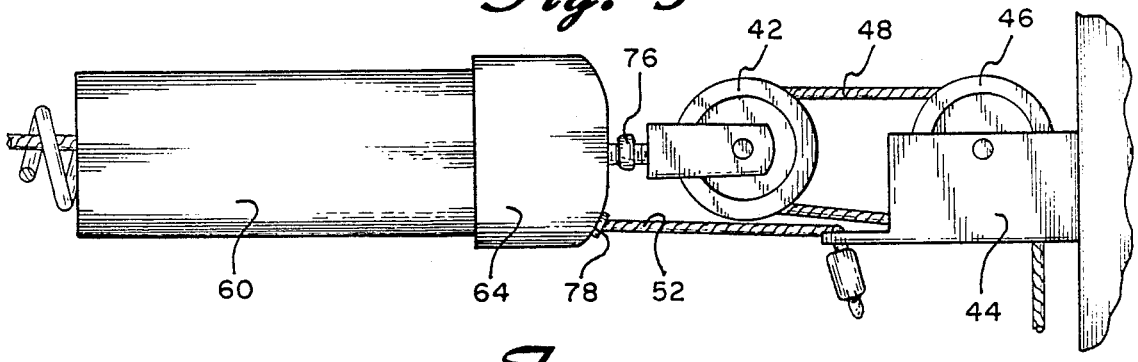
FIG. 5 is an enlarged side elevational view of the forward end of the safety device.
Figure 6:
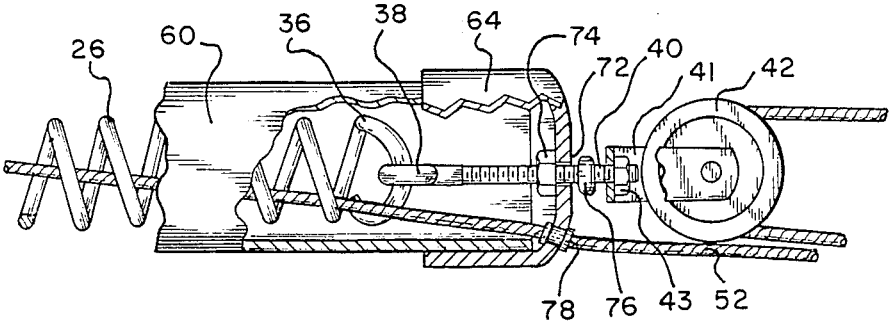
FIG. 6 is a view similar to FIG. 5 but with a portion broken away so as to show the details of the interior thereof.

As can be seen most clearly in FIGS. 4 and 6, the ends 28 and 36 of the spring 26 do not continue the spiral shape of the major portion of the spring. Thus, the rope member 52 does not pass through these end portions. As a result, if the spring should break adjacent its ends, these end portions would not be retained by the rope 52 and could cause injury or damage. To prevent this from occurring, the invention further includes a substantially tubularly shaped member 58 which surrounds the rear end of the spring 26 and a substantially tubularly shaped member 60 which surrounds the forward end of the spring. The axial length of these tubular members is less than half the length of the spring so that only the ends are covered and the center or middle portion of the spring is uncovered whether the spring is in it relaxed or extended condition. Member 58 includes an end cap 62 which may be force fitted or otherwise secured to the member 58 and tubular member 60 includes a similar end cap 64. End caps 62 and 64 substantially close the ends of the tubular members 58 and 60.

As shown most clearly in FIG. 4, the end cap 62 includes a centrally located hole 66 therein which allows the bolt portion of the hook 30 to pass therethrough. Nut 68 retains the tubular member 58 in place by preventing movement to the right as shown in FIG. 4. A shock absorber 70 is located between the outer end of the end cap 62 and the structural member 24. Similarly, as shown most clearly in FIG. 6, end cap 64 includes an opening 72 which allows the bolt portion of hook 38 to pass therethrough. Nut 74 prevents movement of the tubular member 60 to the left as shown in FIG. 6. A shock absorber 76 is located on the bolt at the outside of the end cap 64.

Figure 3:
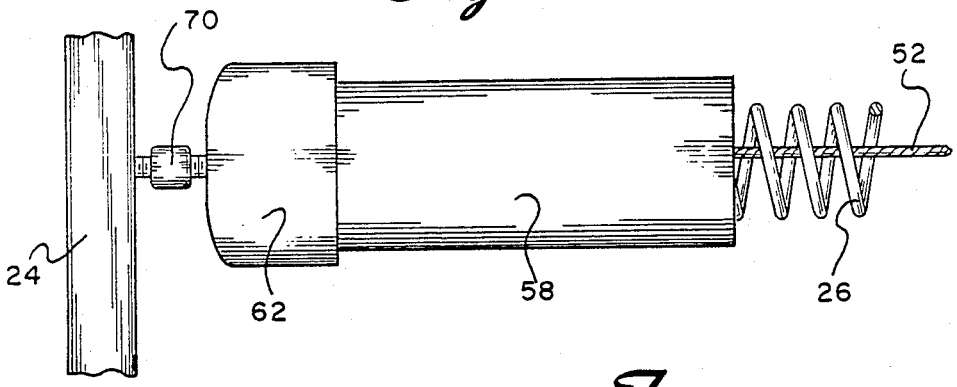
FIG. 3 is an enlarged side elevational view of the rear end of the safety device.

End cap 64 is also provided with an opening or hole 78 which allows the flexible rope 52 to pass therethrough. Although not specifically shown in FIGS. 3 and 4, it is also possible to provide the end cap 62 with a similar hole or opening so that the rear end of the rope 52 can pass through the end cap 62 to be secured directly to the support member 24 as described above. The tubular members 58 and 60 and end caps 62 and 64 may be made of substantially rigid metal or substantially any other material which will not break under the forces which may be applied in the event that the spring breaks and that the ends thereof are projected outwardly. In this way, the tubular members with their end caps will retain any pieces of spring at the ends of the spring which are not retained by the rope 52 and will, therefore, prevent injury or damage.

The present invention may be embodied in other specific forms without departing from the spirit or essential attributes thereof and accordingly reference should be made to the appended claims rather than to the foregoing specification as indicating the scope of the invention.

I claim:

1. In a sectional garage door assembly for a building structure comprising a door opening supporting a vertical track section on each side of the opening; a horizontal overhead section of each track section extending between a front end at said vertical track section and a free rear end; a door with opposite side edges slideably mounted in the respective track sections for movement between a vertical closed position and a horizontal open position; a counterbalance spring assembly associated with each horizontal track section, each assembly comprising a coil spring lying substantially parallel to its respective track section and having its rear end secured to a fixed rear support, the forward end of each spring being connected to a pulley system for assisting in the movement of said door between said closed and said open positions; and an elongated flexible rope member passing through each of said coil springs, each of said rope members having a rear end secured to said fixed rear support and a forward end secured to a fixed forward support, the improvement comprising the rear end of each spring being secured to its respective rear support through a rear bolt which is secured to the rear support so as to allow limited longitudinal movement between each rear bolt and its respective rear support, the forward end of each spring being secured to its respective pulley system through a front bolt which is secured to the pulley system so as to allow limited longitudinal movement between each front bolt and its respective pulley system, a substantially rigid metal tubular member substantially surrounding each end of each of said springs and the connection between the spring and its associated bolt, each of said tubular members including a substantially rigid metal end cap substantially closing one end thereof but having a first opening therein allowing its associated bolt to pass therethrough and a shock absorber surrounding each bolt and lying between the outer surface of its associated end cap and its associated rear support or pulley system, the axial length of each of said tubular members being less than half the length of each spring whereby only the end portions of each spring are surrounded and the center portion thereof is uncovered whether the spring is in its relaxed or extended condition.

2. The improvement as claimed in claim 1 wherein each of the end caps associated with the tubular members surrounding the forward ends of said springs has a opening therein through which its respective flexible rope member passes.

3. The improvement as claimed in claim 2 wherein each of the end caps associated with the tubular members surrounding the rear ends of said springs has a opening therein through which its respective flexible rope member passes.

* * * * *

UNITED STATES PATENT AND TRADEMARK OFFICE

CERTIFICATE OF CORRECTION

PATENT NO. : 4,757,853

DATED : July 19, 1988

INVENTOR(S) : Frank S. Price

It is certified that error appears in the above-identified patent and that said Letters Patent is hereby corrected as shown below:

Column 2, line 52, "invntion" should read --invention--;

Column 6, lines 6 and 11, "opening" should read --second opening--.

Signed and Sealed this

Sixth Day of December, 1988

*Attest:*

DONALD J. QUIGG

*Attesting Officer*

*Commissioner of Patents and Trademarks*